United States Patent [19]

Kodera et al.

[11] Patent Number: 4,497,992

[45] Date of Patent: Feb. 5, 1985

[54] AIR CIRCUIT BREAKER

[75] Inventors: Toshihiko Kodera; Kiyoshi Eguchi; Takayoshi Ishikawa; Yasushi Genba; Shigemi Tamaru; Susumu Satou, all of Fukuyama, Japan

[73] Assignee: Mitsubishi Denki Kabushiki Kaisha, Tokyo, Japan

[21] Appl. No.: 460,790

[22] Filed: Jan. 25, 1983

[30] Foreign Application Priority Data

Jan. 28, 1982 [JP] Japan ..... 57-10973[U]

[51] Int. Cl.[3] ..... H01H 3/30

[52] U.S. Cl. ..... 200/153 SC; 200/67 A; 267/71; 267/179

[58] Field of Search ..... 200/153 SC, 67 A, 153 G; 267/178, 179, 70, 71

[56] References Cited

U.S. PATENT DOCUMENTS

| | | | |
|---|---|---|---|
| 912,927 | 2/1909 | Winans | 267/71 |
| 2,012,404 | 8/1935 | Reyburn | 267/71 X |
| 2,822,568 | 2/1958 | Hosea | 267/178 X |
| 2,895,021 | 7/1959 | Mekelburg | 200/67 A X |
| 2,931,869 | 4/1960 | Frank | 200/67 A |
| 3,653,652 | 4/1972 | Lindberg, Jr. | 267/179 X |
| 3,958,095 | 5/1976 | Zaffrann et al. | 200/153 G |
| 4,095,676 | 6/1978 | Howe et al. | 200/153 SC X |
| 4,114,005 | 9/1978 | Maier | 200/153 G |
| 4,300,027 | 11/1981 | Rask et al. | 200/153 SC X |

FOREIGN PATENT DOCUMENTS

| | | | |
|---|---|---|---|
| 1374768 | 11/1974 | United Kingdom | 200/153 G |

*Primary Examiner*—John W. Shepperd
*Assistant Examiner*—Renee S. Kidorf
*Attorney, Agent, or Firm*—Oblon, Fisher, Spivak, McClelland & Maier

[57] ABSTRACT

The disclosure describes an air circuit breaker including a compression coil; a second spring holder to compress the compression coil in the axial direction thereof; and a first spring holder which is subjected to the compression force of the compression coil, the second spring holder being constructed in such a manner that it is formed of a plate material in a rectangular shape, a pair of projected pieces are provided on both sides of the plate material, and a pin is held to pass between the pair of projected pieces in the direction of thickness of the plate so as to be able to support one end of the energy accumulating spring at four points with the pair of projected pieces and the pin in a compressible manner. After compression of the energy accumulating spring by pressure application thereto, its pressure application is released to stretch the energy accumulating spring so as to close a pair of contact points through the first and second spring holders.

4 Claims, 16 Drawing Figures

AIR CIRCUIT BREAKER

BACKGROUND OF THE INVENTION

1. Field of the Invention

This invention relates to an air circuit breaker, and, more particularly, it is concerned with an air circuit breaker having an improved supporting mechanism for an energy accumulating spring to close a pair of contact points.

2. Description of the Prior Art

In general, this type of circuit breaker is not only required to have good operability in the on-and-off instructions to an operating handle to accumulate pressure force in an energy accumulating spring, but also highly expected to be simplified in its construction and be reduced in its overall dimension.

As this type of the circuit breaker, there has so far been known one as disclosed in, for example, Japanese Utility Model Publication No. 52604/1978. The circuit breaker as taught in this invention uses, as its basic construction, a tension coil spring as the energy accumulating spring to build up energy therein by a push-down operation of the operating handle which is pivotally supported in a housing of the circuit breaker in a rotatable manner and projects outward of the front face of the breaker housing, with which latching device for opening and closing the contact points and latch-releasing device are combined.

In the above-described construction, however, since the energy accumulating spring is the tension coil spring, if it is intended to impart sufficient energy accumulating force to the energy accumulating spring by the push-down operation of the handle, there would arise various problems such that the spring should be disposed, with much trouble and inconvenience, at a place where the spring in its state of having accumulated therein the maximum energy does not occupy a space for arrangement of other component elements; in addition, a construction between the base end of the operating handle and the energy accumulating spring becomes complicated due to presence of an energy accumulating link, an energy accumulating plate, and others; and, besides such complicacy in the construction, since the arranging relationship among the component parts is subjected to restriction, the operating members for closing the contacts, and so on become further difficult to be installed at the side of the front face of the housing where the operation can be done easily.

With the abovementioned points of problem in mind, the present invention successfully solved these problems by use of a compression coil spring as the energy accumulating spring. On the other hand, however, there occurred such a shortcoming that a spring holder for preventing the so-called "collapse" in the energy accumulating energy at the time of its compression became inevitably expensive.

This will be explained hereinbelow in reference to FIG. 1. In the drawing, a reference numeral 332 designates a bearing member fixed on a breaker housing 1 with a bolt 336 and a nut 337. On this bearing member 332, there is rotatably supported a hinge pin 326, on which a disk-shaped first spring holder 335 has been fixed by welding. A reference numeral 338 designates a second spring holder, which is connected with a closed arm 26 through a pin 315 at its distal end part. A numeral 31 refers to an energy accumulating spring made of a compression coil spring, one end part 31*b* of which is supported on the first spring holder 335, and the other end part 31*a* of which is stopped and held at a collar portion 333 in a manner to embrace the outer periphery of the shaft 339 of the second spring holder 338.

The abovementioned second spring holder 338 is subjected simultaneously to an urging force to the side of the first spring holder 335 and a rotational force in the clockwise direction by the counter-clockwise rotation of the closed arm 26 with a certain definite radius of gyration R. At this instant, there is effected compression of the energy accumulating spring 31 between the collar 333 of the second spring holder 338 and the first spring holder 335. At the same time, both first and second spring holders 335 and 338 and the energy accumulating spring 31 are rotated together at the hinge pin 326 so as to correspond to movement of the link 26, while collapsing of the energy accumulating spring is prevented by the shaft 339 of the second spring holder 338.

In the above-described construction, with a view to supporting the end part 31*a* of the energy accumulating spring 31 with good stability, the collar 333 of the second spring holder 338 is formed in a disc-shape so that it may support the entire circumference of the abovementioned end part 31*a* of the spring 31. In contrast to this, the second spring holder 338 is formed by chipping a single monolithic rod. On account of this, the formation of the second spring holder 338 having the collar 333 as mentioned above necessitates use of a raw material (round rod) having a large diameter, which disadvantageously invited increase in the production cost thereof.

Further, since the welding technique is employed for fixing the dish-shaped first spring holder 335 to the hinge pin 326, the assembling efficiency is rather inferior. In addition, the number of component parts for the holder base structure including the first spring holder 335 become increased to also invite disadvantageously rise in the production cost.

SUMMARY OF THE INVENTION

The present invention has been made with a view to eliminating the abovementioned disadvantage inherent in the conventional structure, and aims at providing an air circuit breaker capable of compressing the energy accumulating spring with good stability by an inexpensive structure, wherein a pin is only provided on a spring holder made of a plate material.

The present invention also aims at providing an air circuit breaker with improved assembling efficiency of the base part of the spring holder, and with reduced number of constituent parts for decreasing the production cost.

The present invention further aims at providing an air circuit breaker, in which a second spring holder is pin-connected with a first spring holder in a freely slidable manner so as to effect compression of the energy accumulating spring with good stability, and the pin-connection is effected in a very simple operation.

According to the present invention, in general aspect of it, there is provided an air circuit breaker, comprising: a compression coil; a second spring holder to compress said compression coil in the axial direction thereof; and a first spring holder which is subjected to the compression force of said compression coil, said second spring holder being constructed in such a manner that it is formed of a plate material in a rectangular shape, a pair of projected pieces are provided on both sides of said plate material, and a pin is held to pass between said pair of projected pieces in the direction of thickness of the plate so as to be able to support one end of said energy accumulating spring at four points with said pair of projected pieces and said pin in a compressible manner; and after compression of said energy accumulating spring by pressure application thereto, its pressure application being released to stretch said energy accumulating spring so as to close a pair of contact points through said first and second spring holders.

BRIEF DESCRIPTION OF THE DRAWINGS

The foregoing objects, other objects as well as specific construction and operation of the air circuit breaker according to the present invention will become more apparent and understandable from the following description of it, when read in conjunction with the accompanying drawing.

In the drawing.

In the following, the present invention will be explained in detail with reference to one embodiment thereof as shown in the accompanying drawing.

Figure 2:
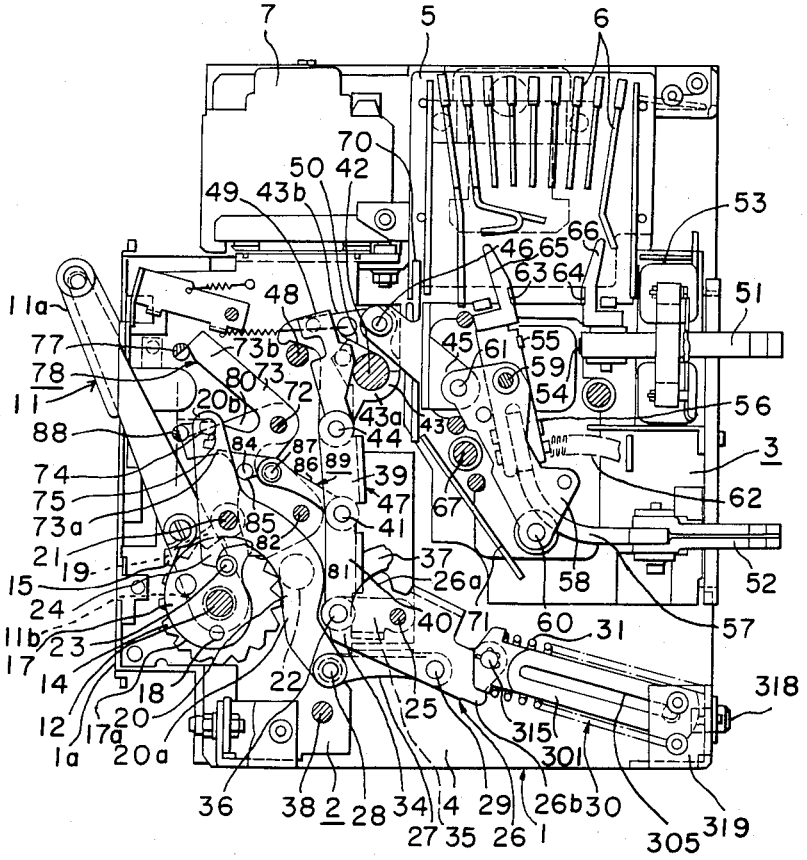
FIG. 2 is a cross-sectional side view showing one embodiment of the air circuit breaker according to the present invention.

FIG. 2 shows a cross-sectional side view showing one embodiment of the air circuit breaker according to the present invention.

In the drawing, a reference numeral 1 designates a housing, a numeral 2 refers to a unit casing for an energy accumulating section, and a numeral 3 denotes a unit casing for an electric conduction section. The unit casing 2 for the energy accumulating section is positioned at the front side (left side as viewed from the top surface of the drawing sheet) of the casing, while the unit casing 3 for the electric conduction section is positioned at the rear side thereof (right side as viewed from the top surface of the drawing sheet). Both unit casings are fixedly secured to a side plate 4 constituting a part of the housing 1. A reference numeral 5 designates an arc extinguishing chamber having a plurality of arc extinguishing plates 6 and being engaged with the abovementioned unit casing 3 for the electric conduction sheet, and a numeral 7 refers to a casing for an electric control section such as a trip relay, and others.

In the following, the constructions of the abovementioned energy accumulating section and electric conducting section will be explained in details.

Figure 3:
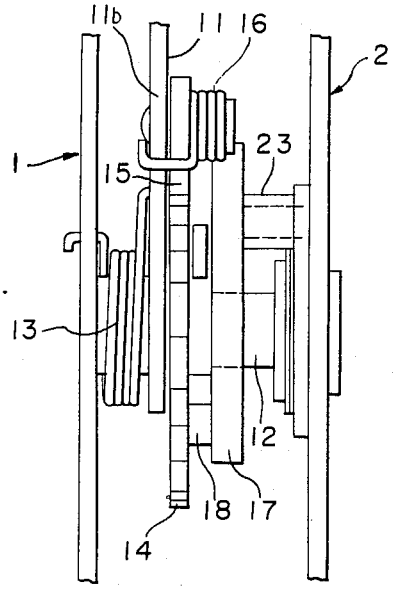
FIG. 3 is an explanatory diagram of a handle axis part.

A reference numeral 11 designates an operating handle disposed in the housing in a posture of a frontward inclination. An operating end part **11*a* of this handle 11 projects outward from the upper portion of a front wall 1*a* of the abovementioned unit casing 2 for the energy accumulating section, while a base end part 11*b* thereof is rotatably pivoted on the abovementioned unit casing 2 for the energy accumulating section by means of a shaft 12 provided at a position close to the lower part of the front face 1*a* of the housing 1. Further, as shown in FIG. 3, a handle returning spring 13 is extended between the base end part 11*b* of the handle 11 and the side of the housing 1. A numeral 14 in FIG. 2 refers to a ratchet coaxially mounted on the abovementioned shaft 12, and a numeral 15 refers to a movable pawl which is pivotally mounted on the base end part 11*b* of the abovementioned handle 11 and is subjected to urging force of an urging spring 16 (see FIG. 3). The movable pawl is rotated to intermittently drive the ratchet 14 counter-clockwise by the push-down operation of the handle 11. A reference numeral 17 designates a cam coaxially mounted on the shaft 12 and integrally coupled with the ratchet 14 by means of a connecting pin 18. The cam 17 is so adapted that it can be driven even by an electric motor (not shown). A numeral 19 refers to a locking pawl which is pivotally mounted on a pivotal shaft of a charge lever to be mentioned later to hinder the return rotation of the abovementioned ratchet 14**.

A numeral 20 refers to the charge lever which extends upward from the back side of the cam 17, and is pivotally supported on a shaft 21 above the cam 17 in a rotatable manner. A roller 22 to be roll-contacted with the cam 17 at the time of the handle operation is mounted on a lower end part **20*a* of the charge lever 20. Further, an obstructing piece 24 to be applied to a roller 23 of the cam 17 at the completion of the pressure accumulation is projectively provided in integration with the charge lever 20. A closed arm 26, an upper end part 26*a* of which is pivotally supported on a shaft 25 in a rotatable manner, is disposed at the rear position of the lower end part 20*a* of the charge lever 20. The closed arm 26 is connected with the lower end of the abovementioned charge lever 20 through a link 27. Reference numerals 28, 29 designate connecting pins in the abovementioned link 27**.

Figure 4:
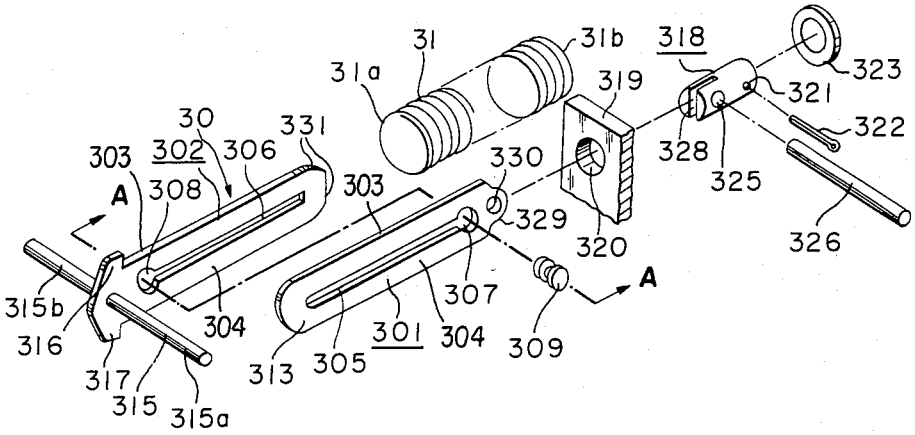
FIG. 4 is an exploded perspective view of a supporting device for the energy accumulating spring.
Figure 5:
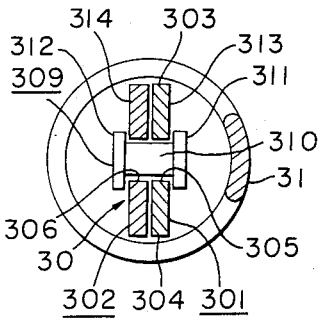
FIG. 5 is a cross-sectional view taken along the line A—A in FIG. 4 showing an assembled state of the spring supporting device.

A reference numeral 30 designates a supporting device for the energy accumulating spring, which has the first spring holder 301 and the second spring holder 302, both being formed of a plate material in a rectangular shape as shown in FIG. 4. Surrounding both spring holders 301, 302, there is fitted from outside an energy accumulating spring 31 made up of a compression coil spring, as shown in FIG. 5, the spring being supported rectilinearly by both up and down end parts 303, 304 of the two spring holders 301, 302. Further, as shown in FIG. 4, in the first spring holder 301 and the second spring holder 302, there are formed mutually parallel guide grooves 305, 306 along the axis of the energy accumulating spring 31, and circular recesses 307, 308 at the extreme ends of the pair of guide grooves 305, 306, the size of which is larger than the width of the grooves. The first spring holder 301 and second spring holder 302 are in parallel contact with each other in a freely slidable manner at one side surface thereof, and are mutually connected by a connecting pin 309, as shown in FIG. 5. In more detail, the connecting pin 309 comprises a shaft portion 310 fitted in the guide grooves 305, 306, and collars 311, 312 at both ends thereof. The diameter of the collars 311, 312 is larger than the width of the guide grooves 305, 306, but smaller than the circular recesses 307, 308. As will be apparent from this, the connecting pin 309 first causes its collars 311, 312 to protrude from the outer surface parts 313, 314 of the two spring holders 301, 302 at the circular recesses 307, 308 of both spring holders 301, 302, after which the shaft part 310 thereof is fitted into the guide grooves 305, 306 to thereby engage both collars 311, 312 with the outer surface parts 313, 314 of both spring holders 301, 302, the second spring holder 302 being connected with the first spring holder 301 in a freely slidable manner in its axial direction, i.e., in its telescopically extending and retracting direction.

Figure 6:
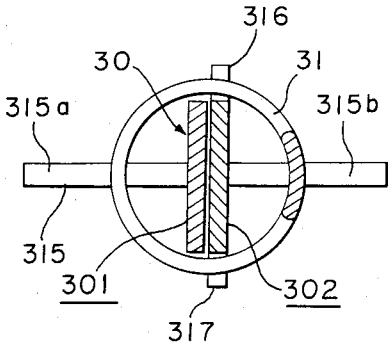
FIG. 6 is an explanatory diagram of a compression supporting part of the energy accumulating spring.
Figure 7:
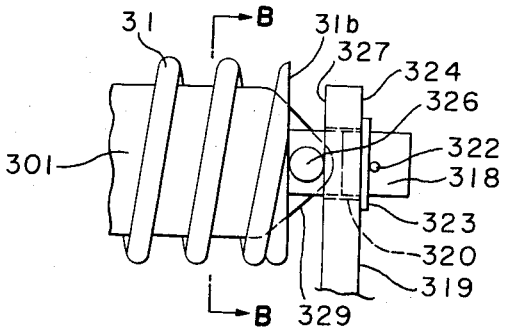
FIG. 7 is a side elevational view showing the base part of the supporting device in its assembled state as shown in FIG. 4.

Further, in FIG. 4, a reference numeral 315 denotes a pin provided at the distal end of the second spring holder 302 passing through the direction of the plate thickness. With this pin 315, the second spring holder 302 is connected with the closed arm 26 shown in FIG. 1, while one end 31*a* of the abovementioned energy accumulating spring 31 is supported at four points, as shown in FIG. 6, with a pair of projected pieces 316, 317 formed on both sides of the distal ends of the second spring holder 302 in the direction of the plate width and with both end parts 315*a*, 315*b* of the abovementioned pin 315. In FIG. 4, a numeral 318 refers to a supporting pin, which is provided with two through-holes 321, 325 passing through it in the diametrical direction thereof. This supporting pin 318 is inserted in a pin hole 320 formed in a spring supporting member 319 as shown in FIGS. 4 and 7, and is engaged with and stopped at one end 324 of the abovementioned spring supporting member 319 through a washer 323 by means of a stopper member 322 such as a split pin, etc. which has been inserted into and engaged with the through-holes 321 in the supporting pin 318, and is further engaged with and stopped at the other end 327 of the spring support member 319 by a hinge pin 326 which has been inserted into the through-hole 325 of the supporting pin 318.

Figure 8:
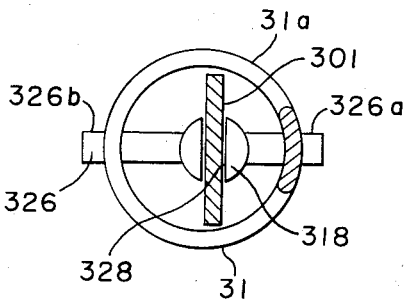
FIG. 8 is a cross-sectional view taken along a line B—B in FIG. 7.

As seen from FIGS. 4 and 8, a recess 328 is formed at one end part of the supporting pin 318. The base part 329 of the first spring holder 301 is fitted in the recessed part 328 to be positioned in the left and right directions thereof, and is rotatably supported on the hinge pin 326 across this recessed part 328. Incidentally, the hinge pin 326 is fixed in the through-hole 325 by means of, for example, pressure-insertion. In FIG. 4, a numeral 330 refers to a shaft hole which is formed in the abovementioned base part 329, and in which is fitted the abovementioned hinge pin 326 in a freely rotatable manner. Furthermore, as shown in FIG. 8, the other end 31*b* of the energy accumulating spring 31 is supported by both end parts 326*a*, 326*b* of the hinge pin 326 straddling over the supporting pin 318, and the abovementioned spring supporting member 319 is fixed on the housing 1.

On the pivotal shaft 25 of the abovementioned closed arm 26 shown in FIG. 2, there is pivotally and rotatably supported a link 35 which is pushed up by a push-up piece 34 on the upper end side of the closed arm 26 and displaces in an arcuate manner at the time of de-energization of the spring force from the abovementioned spring 31. A reference numeral 36 designates a pin which is provided at the displaced end of the link 35 and pushed up by the push-up piece 34; a numeral 37 refers to an arcuate guide slot formed in the abovementioned casing 2, into which the abovementioned pin 36 is fitted; and a numeral 38 denotes an obstructing pin preventing clockwise rotation of the closed arm 26. Numerals 39 and 40 refer to a pair of links which are disposed in the vertical direction on the upper side of the closed arm 26, and connected to each other through a pin 41 in a bendable manner. The lower end part of the lower link 40 is connected with the abovementioned closed arm 26 by the pin 36. A numeral 42 refers to a pivotal shaft which is fixedly positioned above these links 39 and 40, i.e., in front (left side in the drawing) of the abovementioned casing 3 for the electric conduction section, and a numeral 43 denotes a direction changing lever which is pivotally and rotatably held on the shaft 42. To the lower end part 43*a* of this lever 43, there is connected the upper end part of the upper link 39 of the abovementioned pair of links 39 and 40 through the connecting pin 44. The upper end part 43*b* of the lever 43 has a pin 46, to which is connected one end of an insulating link 45 constituting a part of a contact opening and closing mechanism at the side of the electric conduction section, to be explained later. A link mechanism 47 for transmitting accumulated energy force is constructed with the abovementioned pair of links 39, 40 and associated elements. A reference numeral 48 designates an obstructing shaft against the counter-clockwise rotation of the lever 43; a numeral 49 refers to a preventive member which prevents the lever 43 from its spring-back motion; and a numeral 50 indicates a return spring for this preventive member 49.

Numerals 51 and 52 refer to a pair of conductors constituting a part of the electric conduction section; a reference numeral 53 designates a current transformer provided in one of the conductors (51); and a numeral 54 denotes a main fixed contact point secured at the distal end of this conductor 51. A reference numeral 56 represents a movable piece, on which the movable contact 55 is fixedly secured. The base end part of this movable piece 56 and the other conductor 52 are connected with a flexible conductor 57. A numeral 58 denotes a movable piece holder to hold the movable piece 56 through a pivot pin 59. The lower end part of this holder 58 is pivotally and rotatably supported on the casing 3 through a pivotal shaft 60, while the upper end part thereof is connected to other end of the abovementioned insulating link 45 through a pin 61. A numeral 62 refers to a contact-pressing spring which extends between the abovementioned movable piece 56 and the side wall of the casing 3 to impart to this movable piece 56 a spring force in the direction of the contact closure; numerals 63 and 64 respectively refer to a movable arc contact and a fixed arc contact; numerals 65 and 66 denote respectively holding members for the arc contacts 63 and 64; and a numeral 67 refers to a stopper for restricting rotation of the movable piece holder 58. A contact opening and closing mechanism 69 is constructed with the abovementioned movable piece 56, movable piece holder 58, insulating link 45, and associated elements (see FIGS. 2, 12 and 13). Reference numerals 70 and 71 designate partition walls.

Figure 9:
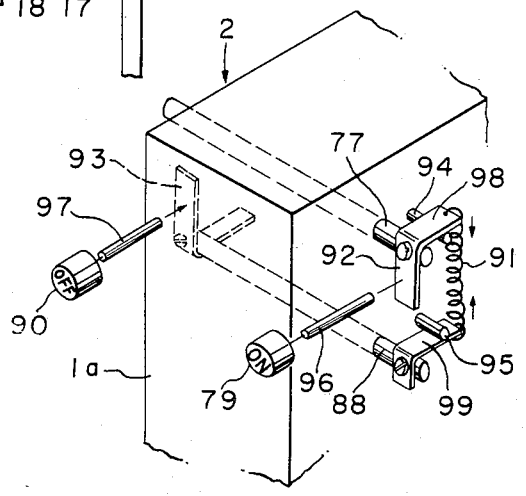
FIG. 9 shows a schematic constructional diagram of on-and-off operating sections.

At a position above the charge lever 20, there is disposed a closing latch 73 in the form of a letter "J" or a fishhook, which is pivotally supported on a pivotal shaft 72 in a rotatable manner. At the distal end of the lower end part 73*a* of this latch 73, there is formed a notched portion 75 to receive therein urging force in the clockwise direction of an engaging and stopping roll 74 fixed at the upper end part 20*b* of the charge lever 20. The notched portion is so set that, at the completion of the pressure accumulation, the abovementioned urging force may be against the clockwise spring force of the return spring 76 (see FIG. 10). A reference numeral 77 designates a latch having a D-shaped cross-section which engages and stops the upper end 73*b* of the abovementioned closing latch 73 in an engageable and disengageable manner to hinder the counterclockwise rotation thereof. The latch 77 is rotatably mounted on the casing 2, and constructs a stand-by maintaining mechanism 78 for the contact closure together with the abovementioned closing latch 73, and others. As shown in FIG. 9, the D-shaped latch 77 is so adapted that it may rotate counter-clockwise by an ON-operating member 79 which releases the abovementioned stand-by state of the contact closure.

Figure 10:
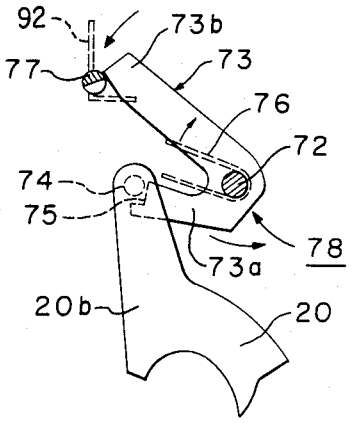
FIG. 10 is an explanatory diagram of a stand-by maintaining mechanism for closing the contact points.
Figure 11:
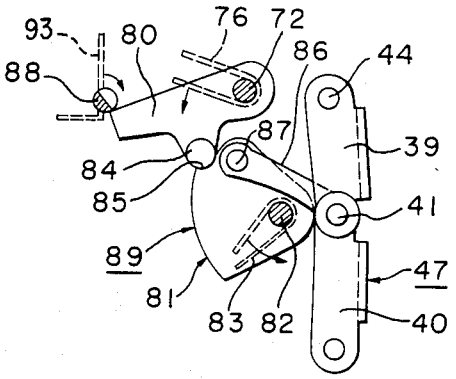
FIG. 11 is an explanatory diagram of a stand-by maintaining mechanism for opening the contact points.

A numeral 80 refers to a trip latch which is rotatably pivoted on the pivotal shaft 72 of the closing latch 73 and is subjected to a counter-clockwise spring force of the abovementioned return spring 76 (see FIG. 10). A numeral 81 refers to a cam plate which is rotatably pivoted on a shaft 82 below the trip latch 80, and to which the counter-clockwise spring force of the return spring 83 shown in FIG. 11 is imparted. The cam plate 81 is so constructed that it has a recessed portion 85 to be engaged with an engaging and stopping roll 84 at the projected lower end part of the trip latch 80 in an engageable and disengageable manner, and imparts to the trip latch 80 clockwise urging force against force of the return spring 72. A reference numeral 86 in FIG. 2 designates a cross-bridging link connected between a pin 87 of the cam plate 81 and the connecting pin 41 in the abovementioned pair of links 39 and 40. A numeral 88 refers to a latch having a D-shaped cross-section to inhibit the clockwise rotation of the abovementioned trip latch 80. The latch 88 is rotatably mounted on the casing 2, and constructs, together with the abovementioned trip latch 80 and the cam plate 81, a stand-by maintaining mechanism 89 for the contact opening, which causes the abovementioned link mechanism 47 to stretch against the spring force of the abovementioned contact-pressing spring 62. The D-shaped latch 88 is so formed that it may be rotated in the clockwise direction by the OFF-operating member 90 shown in FIG. 9. Incidentally, in FIG. 9, a reference numeral 91 designates an automatic return spring for the D-shaped latches 77 and 88; numerals 92 and 93 respectively refer to members provided on the D-shaped latches 77 and 88, and to be subjected to operation; 94 and 95 denote stoppers; 96 and 97 represent push-in rods; and 98 and 99 denote stopper arms operatively associated with stoppers 94, 95 and latches 77, 88, respectively.

In the following, actual operations of the abovementioned construction will be explained.

Figure 14:
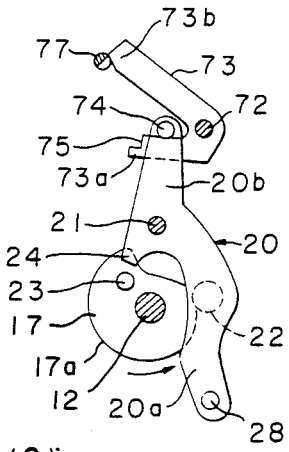
FIG. 14A depicts position of charge lever prior to compression operation.
FIG. 14B depicts charge lever at maximum counter-clockwise position during compression operation.
FIG. 14C depicts charge lever engaged with closing latch at completion of compression operation.
Figure 14:
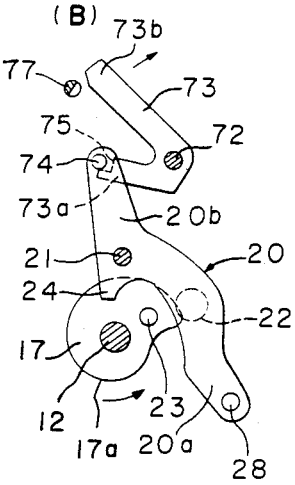
Figure 14:
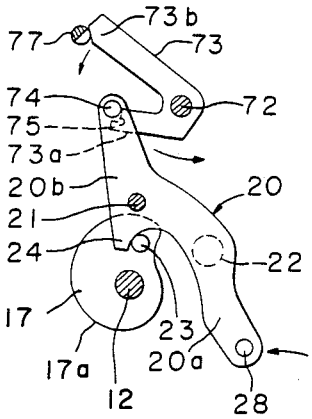

(I) At the time of energy accumulation in the energy accumulating spring:

First of all, when the handle 11 in FIG. 2 is subjected to push-down operation against force of the return spring 13 the movable pawl 15 rotates the ratchet 14 in the counter-clockwise direction, and the cam 17 is thereby rotated in the same direction; accordingly, the charge lever 20 is rotated counter-clockwise with its shaft 21 as the center of rotation through the roller 22 which is roll-contacted to the cam surface 17*a* (see FIG. 14A). By this rotational displacement of the charge lever 20 in the counter-clockwise direction, the closed arm 26 rotationally displaces in the counter-clockwise direction around the shaft 25 through the link 27, whereby application of the pressure by the second spring holder 302 commences, and the second spring holder 302 is pushed back along the guide grooves 305, 306 relative to the first spring holder 301, while the energy accumulating spring 31 is compressed between the projected pieces 316, 317 of the second spring holder 302, and between the pin 315 and the hinge pin 326, and the two spring holders 301, 302 are rotated clockwise with the hinge pin 326 as its center of rotation in a state of linearly supporting the energy accumulating spring 31 at both upper and lower end parts 303, 304 thereof (see FIG. 5) so as to correspond to the rotation of the closed arm 26 in FIG. 2. The abovementioned energy accumulating spring 31 further proceeds its compression-deformation by the repeated handle operation.

By carrying out the push-down operation of the abovementioned handle 11 for a predetermined number of times, e.g., several times, the cam 17 is slightly rotated in the counter-clockwise direction from a position where the charge lever 20 is displaced in its maximum amount (see FIG. 14(B)), while, at the same time, the roller 23 collides with the obstructing member 24 on the charge lever 20 (see FIG. 14(C)), whereby rotation of the cam 17 is hindered and the pressure accumulating operation of the energy accumulating spring 31 is completed (a state shown in FIG. 2.)

At the completion of the abovementioned pressure accumulating operation, stretching force of the energy accumulating spring 31 tends to rotate the abovementioned charge lever 20 about its shaft 21 in the clockwise direction through the closed arm 26 and the link 27. On account of this, the engaging and stopping roll 74 at the upper end of the charge lever 20 urges the notched part 75 at the lower end of the closing latch 73 to cause the latch to rotate counter-clockwise against force of the return spring 76. However, on account of the abovementioned counter-clockwise rotation of the closing latch 73, the upper end 73*b* of the closing latch is engaged with, and stopped at, the D-shaped latch 77, and the counter-clockwise rotation of the closing latch 77, in other words, the clockwise rotation of the charge lever 20, is hindered (see FIGS. 10 and 14(C)). Accordingly, the push-up force of the closed arm 26 with respect to the pin 36 in the link mechanism 47 is also hindered, and the closure of the contacts 54, 55 is set in a stand-by state through the abovementioned link mechanism 47.

Figure 12:
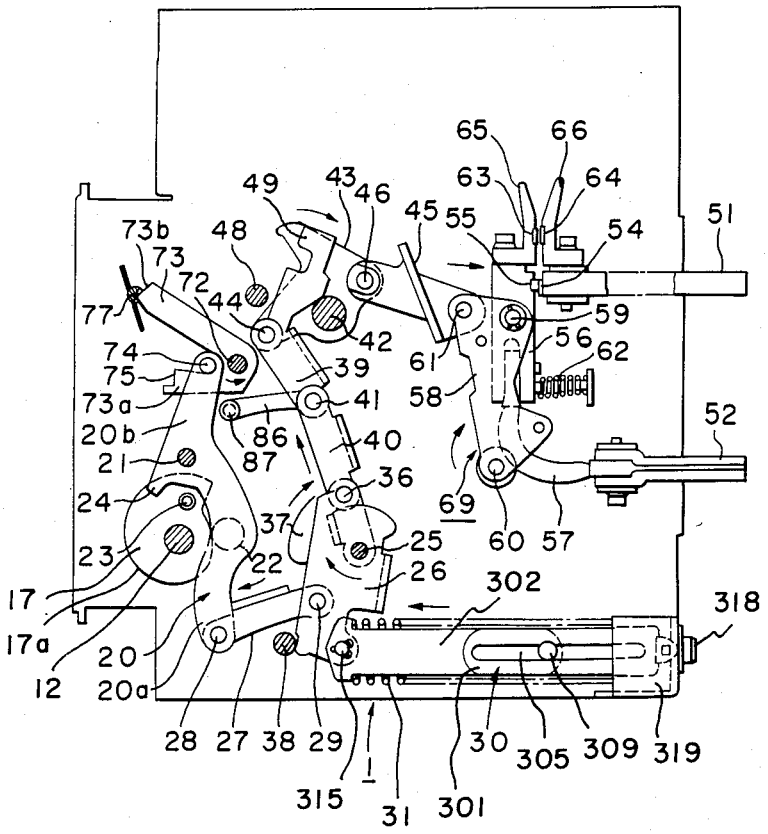
FIG. 12 is a diagram showing a state of performance of the breaker at its ON-operation.

(II) At the time of ON-operation:

At first, when the ON-operating member 79 shown in FIG. 9 is operated against force of the return spring to rotate the D-shaped latch 77 in the counter-clockwise direction, the closing latch 73 rotates counter-clockwise from its state as shown in FIG. 14(C). On account of this, the engaging and stopping roll 74 at the upper end part 20*b* of the charge lever 20 is released from the notched part 75 of the closing latch 73, and the charge lever 20 is subjected to the force of the energy accumulating spring to be rotated in the clockwise direction, as shown in FIG. 12. In consequence of this, the closed arm 26 is also rotated about the shaft 25 in the clockwise direction through the link 27, whereby application of pressure to the second spring holder 302 is released, and both spring holders 301, 302 are reversely rotated to return to their original state as shown in FIG. 12. By the rotation of the abovementioned closed arm 26 under force of the energy accumulating spring, the push-up piece 34 of this closed arm 26 pushes the pin 36 upward and moves the same along the guide slot 37, hence the pair of links 39 and 40 are also displaced upward and driven in their stretched state.

By the upward displacement of the links 39 and 40, the direction changing lever 43 rotates clockwise. The rotational force of this lever 43 is transmitted to the contact point opening and closing mechanism 69 through the insulated link 45. In more detail, since the holder 58 of the movable piece 56 is rotated clockwise with its shaft 60 as the center of rotation, the movable contact 55 comes into contact with the fixed contact point 54 against force of the contact-pressing spring 62 to bring about the contact point closure state. In this state, the energy accumulating spring 31 is de-energized, while the contact-pressing spring 62 is compressed for energy accumulation.

In the state as mentioned above where the energy accumulating spring 31 is de-energized and the contact points 54 and 55 are closed, the spring force of the contact-pressing spring 62 tending to stretch is about to rotate the direction changing lever 43 around the shaft 42 in the counter-clockwise direction through the movable piece 56, holder 58 and insulated link 45.

Incidentally, since the abovementioned direction changing lever 43 is subjected to the rotational force in the counter-clockwise direction, the pair of links 39 and 40 connected with this lever 43 are subjected to the rightward urging force, by which urging force the cam plate 81 is subjected to the clockwise rotational force about the shaft 82 through the link 86 as shown in FIG. 11. On account of this, the cam plate 81 pushes up the trip latch 80 against force of the return spring 83 to impart clockwise rotational force to this trip latch 80, although this rotational force is hindered by the D-shaped latch 88. On account of this, the engaged state between the abovementioned recessed part 85 and the engaging and stopping roll 84 remains as it is, whereby the cross-bridging force due to the link 86 acts on the abovementioned links 39 and 40. Accordingly, the pair of links 39 and 40 are maintained their stretched condition against the stretching force of the contact-pressing spring 62. This, in other words, sets the stand-by maintenance mechanism for opening the contact point to be in its on-state.

(III) At the time of OFF-operation

Figure 13:
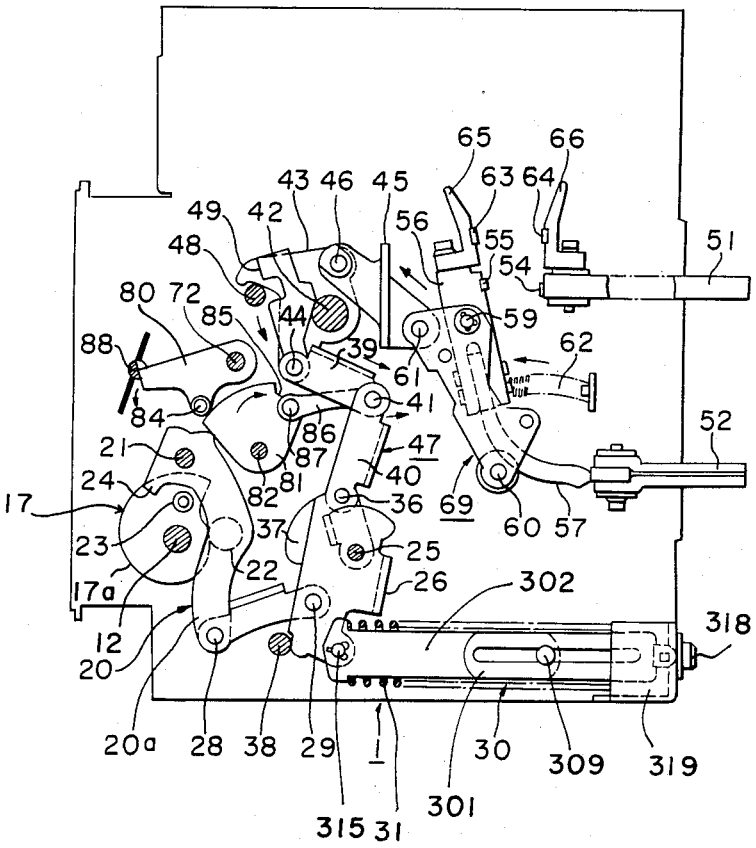
FIG. 13 is a diagram showing a state of performance of the breaker at its OFF-operation.

At first, when the OFF-operating member 90 shown in FIG. 9 is operated against force of the automatic return spring to rotate the D-shaped latch 88 in the clockwise direction, the trip latch 80 slightly displaces rotationally in the clockwise direction against force of the return spring 76 from its state as shown in FIG. 11, whereby the engaging and stopping roll 84 of this latch 80 and the recessed part 85 of the cam plate 81 are released from their engagement. On account of this, the abovementioned cam plate 81 is rotated clockwise as shown in FIG. 13 against force of the return spring 83. As the consequence of this, the cross-bridging action of the link 86 is reduced, and the pair of links 39 and 40 are bent down in a collapsed fashion due to the stretching force of the abovementioned contact-pressing spring 62, whereby the abovementioned contacts 54 and 55 are opened.

In the open state of the contact points 54 and 55, i.e., in the state as shown in FIG. 13, when the abovementioned handle operation is resumed for the pressure accumulation in the energy accumulating spring 31, the links 39 and 40 are stretched accordingly, while displacing downward, and the cam plate 81 is rotationally displaced counter-clockwise by the force of the return spring 83, hence the recessed part 85 of the cam plate 81 becomes engaged with the engaging and stopping roll 84 of the trip latch 80 to thereby assume the state shown in FIG. 2.

Here, in the above-described embodiment, one end 31*a* of the energy accumulating spring 31 is constructed so as to be supported on four points in a compressible manner with a pair of projected pieces 316, 317 provided at both sides in the breadthwise direction of the spring holder 302 formed of a plate material in a rectangular shape, and a pin 315 which passes between the pair of the projected pieces 316, 317 in the direction of the plate thickness. However, the spring holder 302, including the projected pieces 316, 317 at the distal ends thereof, made of such plate material can be obtained at a cheap cost by punching work, while the pin 315 can be obtained by shearing work of a wire rod material. By the abovementioned fourpoint support, the compression for the energy accumulating spring 31 can be done with good stability.

Figure 1:
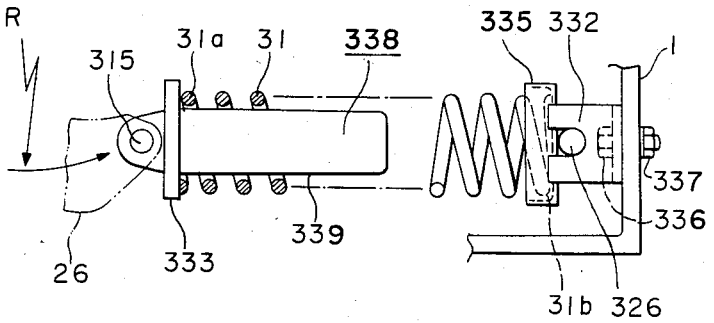
FIGURE 1 PRIOR ART
FIG. 1 is a side view, partly cut away, of a supporting device for an energy accumulating spring in a conventional air circuit breaker.

Incidentally, the first spring holder 301 shown in the above-described embodiment can be substituted for the first spring holder 325 shown in FIG. 1, hence, in this case, the collapse of the energy accumulating spring 31 is prevented by the second spring holder 302 in the same manner as has been done heretofore.

In the above-described embodiment, the component parts for the base part of the spring holder (see FIG. 7) may sufficiently comprise at least three of the supporting pin 318, the stopper member 322, and the hinge pin 326, so that the number of the component parts for the spring holder base part becomes less than that of the conventional base part structure with the consequent decrease in the manufacturing cost. Further, since no welding work is required for assembling the spring holder base part, its assembling efficiency can also be improved.

Here, in this embodiment, the second spring holder 302 adequately slides relative to the first spring holder 301, at the time of compressing the energy accumulating spring 31, by means of the guide grooves 305, 306 and the connecting pin 309. That is to say, the inner end part 331 of the second spring holder 302 (see FIG. 4) does not become unsteady upon its collision against the energy accumulating spring 31, and the spring can be compressed with good stability. Moreover, the connection between the first spring holder 301 and the second spring holder 302 can be effected instantaneously by a simple operation of inserting the shaft portion 310 of the connecting pin 309 from the circular recesses 307, 308 of both spring holders 301, 302 into the respective guide grooves 305, 306.

Although, in the foregoing, the present invention has been described with particular reference to a preferred embodiment thereof, it should be understood that the embodiment is merely illustrative and not restrictive, and that any changes and modifications may be made by those persons skilled in the art within the spirit and scope of the invention as recited in the appended claims.

We claim:

1. An air circuit breaker including an energy accumulating spring, a pair of contact points, and transmitting means for compressing said energy accumulating spring, for transmitting a compression force of said energy accumulating spring during expansion thereof to close said pair of contact points, and for causing pivoting of said energy accumulating spring during said compression and expansion, comprising:

an energy accumulating spring adapted to be compressed for storing energy therein and expanded for closing said pair of contact points;

a second spring holder operatively associated with said transmitting means, said second spring holder comprising means for axially supporting said energy accumulating spring during an axial compression thereof to preclude a non-axial displacement of said energy accumulating spring due to pivoting thereof, said second spring holder comprising means for compressing said energy accumulating spring while said second spring holder and said energy accumulating spring are simultaneously subjected to pivoting; said second spring holder further comprising a rectangularly shaped plate, a pin affixed in and extending through said rectangularly shaped plate and having first and second ends adapted to support a first end of said energy accumulating spring, said pin comprising a pivotal connection between said second spring holder and said transmitting means, and first and second projected pieces extending from said rectangularly shaped plate proximal said transmitting means and adapted to support said first end of said energy accumulating spring;

said first and second projected pieces and said first and second ends of said pin comprising means for simultaneously cooperating with said energy accumulating spring to transmit a compression force transmitted by said transmitting means; and a first spring holder comprising means for precluding said non-axial displacement of said energy accumulating spring due to pivoting thereof, wherein said compression force stored in said energy accumulating spring is transmitted to said transmitting means during said expansion of said energy accumulating spring to close said pair of contact points.

2. The air circuit breaker as claimed in claim 1 further comprising a hinge pin for pivotally supporting an end of said first spring holder and a second end of said energy accumulating spring, and wherein said first spring holder further comprises a rectangularly shaped plate having a shaft hole in one end thereof for receiving said hinge pin, and wherein said first spring holder is disposed parallel to and in contact with said second spring holder.

3. The air circuit breaker according to claim 1 further comprising a connecting pin including a shaft portion having first and second collars affixed thereto and wherein said first spring holder has a first axial guide groove formed therein, said first axial guide groove having a first circular recess formed in an end thereof, and said second spring holder has a second axial guide groove formed therein, said second axial guide groove having a second circular recess formed in an end thereof and wherein said shaft portion of said connecting pin is slidably disposed in said first and second axial grooves by inserting one of said first and second collars through said first and second circular recesses, said first and second collars engaging outer surfaces of said first and second spring holders to freely slidably connect said first spring holder to said second spring holder.

4. The air circuit breaker as claimed in claim 1 further comprising:

a spring supporting member having a pin hole formed therein;

a supporting pin disposed in said pin hole;

a stopper member operatively associated with said supporting pin for abutting a first face of said spring supporting member such that said supporting pin is stopped and engaged thereby; and a hinge pin operatively associated with said supporting pin for abutting a second face of said spring supporting member to stop and engage said supporting pin thereby and wherein said hinge pin comprises means for pivotally supporting said first spring holder and said energy accumulating spring such that during compression of said energy accumulating spring said first spring holder, said second spring holder and said energy accumulating spring pivot about said hinge pin in a first direction and during expansion of said energy accumulating spring said first spring holder, said second spring holder and said energy accumulating spring pivot about said hinge pin in a second direction.

* * * * *